US010138716B2

(12) United States Patent
Fisher et al.

(10) Patent No.: US 10,138,716 B2
(45) Date of Patent: Nov. 27, 2018

(54) MODULAR NOZZLE INFLOW CONTROL DEVICE WITH AUTONOMY AND FLOW BIAS

(71) Applicants: Britain A. Fisher, Houston, TX (US); Joshua Raymond Snitkoff, Houston, TX (US)

(72) Inventors: Britain A. Fisher, Houston, TX (US); Joshua Raymond Snitkoff, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 133 days.

(21) Appl. No.: 15/157,981

(22) Filed: May 18, 2016

(65) Prior Publication Data

US 2017/0335661 A1 Nov. 23, 2017

(51) Int. Cl.

| | |
|---|---|
| ***E21B 41/00*** | (2006.01) |
| *E21B 17/18* | (2006.01) |
| *E21B 43/08* | (2006.01) |
| *E21B 43/16* | (2006.01) |

(52) U.S. Cl.

CPC ..... *E21B 41/0078* (2013.01); *E21B 17/18* (2013.01); *E21B 43/08* (2013.01); *E21B 43/16* (2013.01)

(58) Field of Classification Search

CPC ..... E21B 41/0078

See application file for complete search history.

(56) References Cited

U.S. PATENT DOCUMENTS

| | | | | |
|---|---|---|---|---|
| 4,782,896 | A | 11/1988 | Witten | |
| 6,158,510 | A | 12/2000 | Bacon et al. | |
| 7,296,633 | B2 | 11/2007 | Bode et al. | |
| 2008/0041582 | A1 | 2/2008 | Saetre et al. | |
| 2009/0000787 | A1 | 1/2009 | Hill et al. | |
| 2011/0017459 | A1 | 1/2011 | Dinkins | |
| 2011/0162840 | A1 | 7/2011 | Haeberle et al. | |
| 2015/0184806 | A1* | 7/2015 | Beg | F17D 1/02 137/12 |

FOREIGN PATENT DOCUMENTS

| | | | |
|---|---|---|---|
| WO | 2015038265 | A2 | 3/2015 |
| WO | 2015069759 | A2 | 5/2015 |

OTHER PUBLICATIONS

Ellis, et al.; "Inflow Control Devices-Raising Profiles"; Oilfield Review; Winter 2009/2010; Retrived from the Internet:; http://www.slb.com/~/media/Files/resources/oilfield_review/ors09/win09/03_inflow_control_devices.pdf; 8 pages.

International Search Report and the Written Opinion of the International Searching Authority;PCT/US2017/026123; Korean Intellectual Property Office; dated Jul. 3, 2017; 9 pages.

* cited by examiner

*Primary Examiner* — D. Andrews
*Assistant Examiner* — Kristyn A Hall
(74) *Attorney, Agent, or Firm* — Cantor Colburn LLP

(57) ABSTRACT

An apparatus for controlling a flow of fluid downhole comprises a removable fluid nozzle in fluid communication with a production tubular disposed in a borehole penetrating the earth. The removable fluid nozzle is configured for bi-directional flow, wherein a pressure drop of fluid flow in one direction is greater than the pressure drop of fluid flow in the other direction.

20 Claims, 9 Drawing Sheets

MODULAR NOZZLE INFLOW CONTROL DEVICE WITH AUTONOMY AND FLOW BIAS

BACKGROUND

The efficiency of oil producing wells is being improved by increasing their length and thus contact area in hydrocarbon producing earth formations. Unfortunately, long horizontal wells may result in uneven production due to reservoir heterogeneity along the length of the horizontal bore and may lead to early water or gas breakthrough in these bores. In order to prevent an early breakthrough from occurring, inflow control devices (ICDs) are disposed in production tubing along the horizontal bore to create a more even inflow by producing an additional pressure drop at inflow points along the production tubing. Due to the heterogeneity of the formation, different pressure drops may be needed in order to create the more even inflow. Hence, it would be well received in the hydrocarbon production industry if ICDs could be readily modified to change their individual pressure drops characteristics.

BRIEF SUMMARY

Disclosed is an apparatus for controlling a flow of fluid downhole. The apparatus includes a removable fluid nozzle in fluid communication with a production tubular disposed in a borehole penetrating the earth, the removable fluid nozzle being configured for bi-directional flow, wherein a pressure drop of fluid flow in one direction is greater than the pressure drop of fluid flow in the other direction.

Also disclosed is a method for controlling a flow of fluid downhole. The method includes receiving the fluid using a removable fluid nozzle in fluid communication with a production tubular disposed in a borehole penetrating the earth. The removable fluid nozzle is configured for bi-directional flow, wherein a pressure drop of fluid flow in one direction is greater than the pressure drop of fluid flow in the other direction. The method further includes flowing the fluid between the removable fluid nozzle and the production tubular in order to control the flow of the fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are embodiments of apparatus and methods for controlling inflow of fluid, such as oil, from an earth formation and/or controlling injection fluid flow into the earth formation. In general, fluid inflow relates to fluid flowing from a reservoir in the earth formation and into a production tubular disposed in a borehole penetrating the earth. The formation fluid then flows in the production tubular to the surface. The inflow is controlled by reducing the pressure of the fluid using a plurality of pressure reducing nozzles that are coupled together in a series arrangement. The series of nozzles is disposed in an outer annulus of a basepipe to which the series of nozzles discharges the fluid. The basepipe is connected to the production tubular. A cap seals an end of the annulus and is removable in order to access the series of nozzles when the nozzle assembly is removed from the borehole. Any nozzle or combination of nozzles in the series may be replaced with another nozzle or nozzles having a different pressure drop characteristic to enable a desired pressure drop throughout the series to provide a more even inflow into the production tubular. The modular nature of the nozzles provides for efficient installation of inflow control devices (ICDs) without having to change an entire ICD in order to change the pressure drop characteristic of that ICD. The geometry of the nozzles is such that they create a higher pressure drop for fluids with a higher density (e.g., water) and a lower pressure drop for fluids with a lower density (e.g., oil). Thus, the series of nozzles passively and autonomously rejects water in favor of oil in the inflow direction. Alternatively, injection fluid may flow in the reverse direction, i.e., from the surface in the production tubular, through the series of nozzles, and into the formation. The pressure drop in this reverse direction is less than the pressure drop in the inflow direction to aid in the injection of fluid to increase hydrocarbon production.

Figure 1:
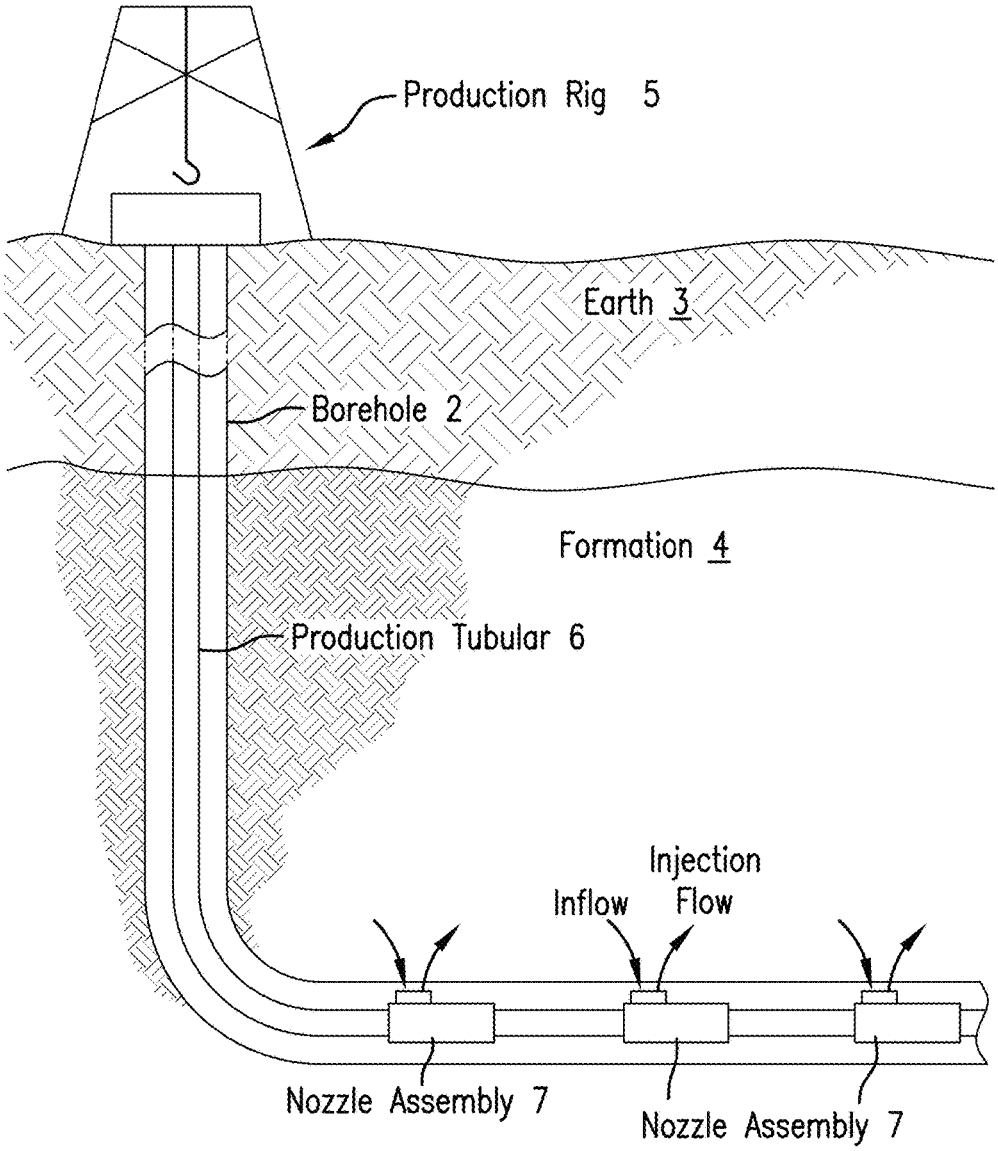
FIG. 1 depicts aspects of a plurality of flow nozzle assemblies coupled to a production tubular disposed in a borehole penetrating an earth formation.

FIG. 1 is a cross-sectional view of a borehole 2 penetrating the earth 3 having an earth formation 4 which contains an oil reservoir. A production tubular 6 is disposed in the borehole 2 and is connected to one or more nozzle assemblies 7. In the embodiment of FIG. 1, the nozzle assemblies 7 are configured to be in series. Each nozzle assembly 7 is configured to receive an inflow of formation fluid from the formation 4 and direct flow of the formation fluid into the production tubular 6 where it is pumped to the surface and/or inject an injection fluid, received from the production tubular 6, into the formation 4. A production rig 5 is configured to perform hydrocarbon production operations such as pumping the formation fluid in the production tubular 6 to the surface and injecting an injection fluid into the formation 4 as non-limiting embodiments.

Figure 2:
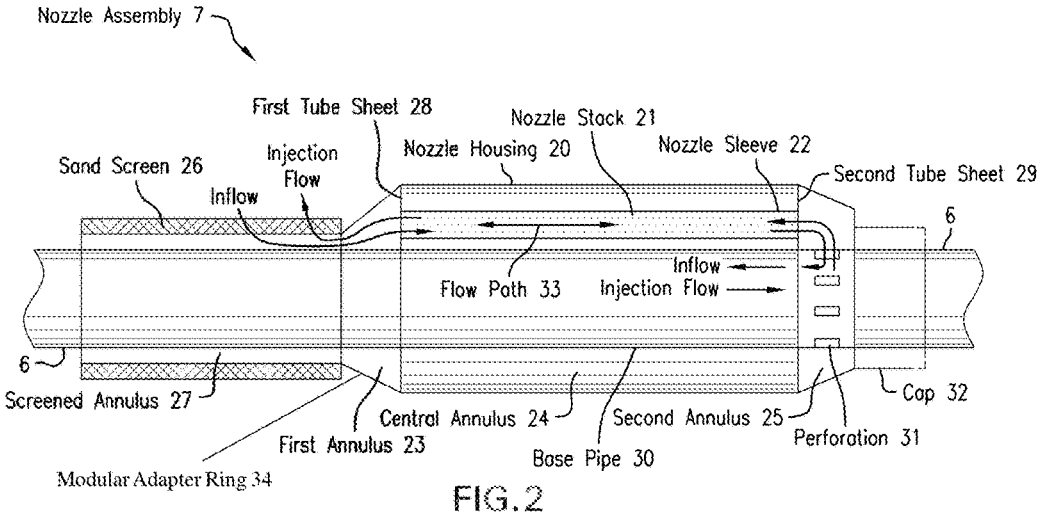
FIG. 2 depicts aspects of a flow nozzle assembly.

FIG. 2 illustrates a cross-sectional view of an embodiment of the nozzle assembly 7. The nozzle assembly 7 includes a basepipe 30 that is configured to be coupled to the production tubular 6. A nozzle housing 20 at least partially surrounds the basepipe 30 to form a first annulus 23, a central annulus 24 and a second annulus 25. A nozzle stack 21 is disposed in the central annulus 24 and supported by a first tube sheet 28 at one end and a second tube sheet 29 at an opposing end. The nozzle stack 21 defines a flow path 33 for an inflow direction and/or an injection flow direction. The nozzle stack 21 includes a series of flow nozzles disposed in a nozzle sleeve 22. In an alternative embodiment, a single flow nozzle may be disposed in the nozzle sleeve 22 where the single flow nozzle provides a desired fluid pressure drop characteristic for the flow path 33 cap 32 is removably coupled to the second annulus 25 such as by a threaded connection. Other types of mechanical connections may also be used. When the cap 32 is removed, access is provided to the nozzles in the nozzle stack 21 in order to remove or replace any of the nozzles. The basepipe 30 includes one or more perforations 31 for directing inflow from the second annulus 25 into the basepipe 30 and/or directing injection flow from the basepipe 30 into the second annulus 25.

The nozzle assembly 7 may optionally include a sand screen 26 for screening sand or particles from formation fluid flowing into a screened annulus and then into the first annulus 23. The first annulus may be implemented by a modular adapter ring 34 configured to adapt the screened annulus to the central annulus such that fluid communication is provided between the screened annulus and the at least one flow path. Formation fluid in the first annulus 23 flows into the nozzle stack 21 and then into the second annulus 25. In the reverse direction, injection fluid flows from the second annulus 25, through the nozzle stack 21 and into the first annulus 23. From the first annulus 25, the injection fluid flows into the screened annulus 27, through the sand screen 26 and into the formation 4.

The nozzle assembly 7 is made from a material or materials that can survive the high temperatures, high pressures and chemicals in a downhole environment such as steel in a non-limiting embodiment.

Figure 3:
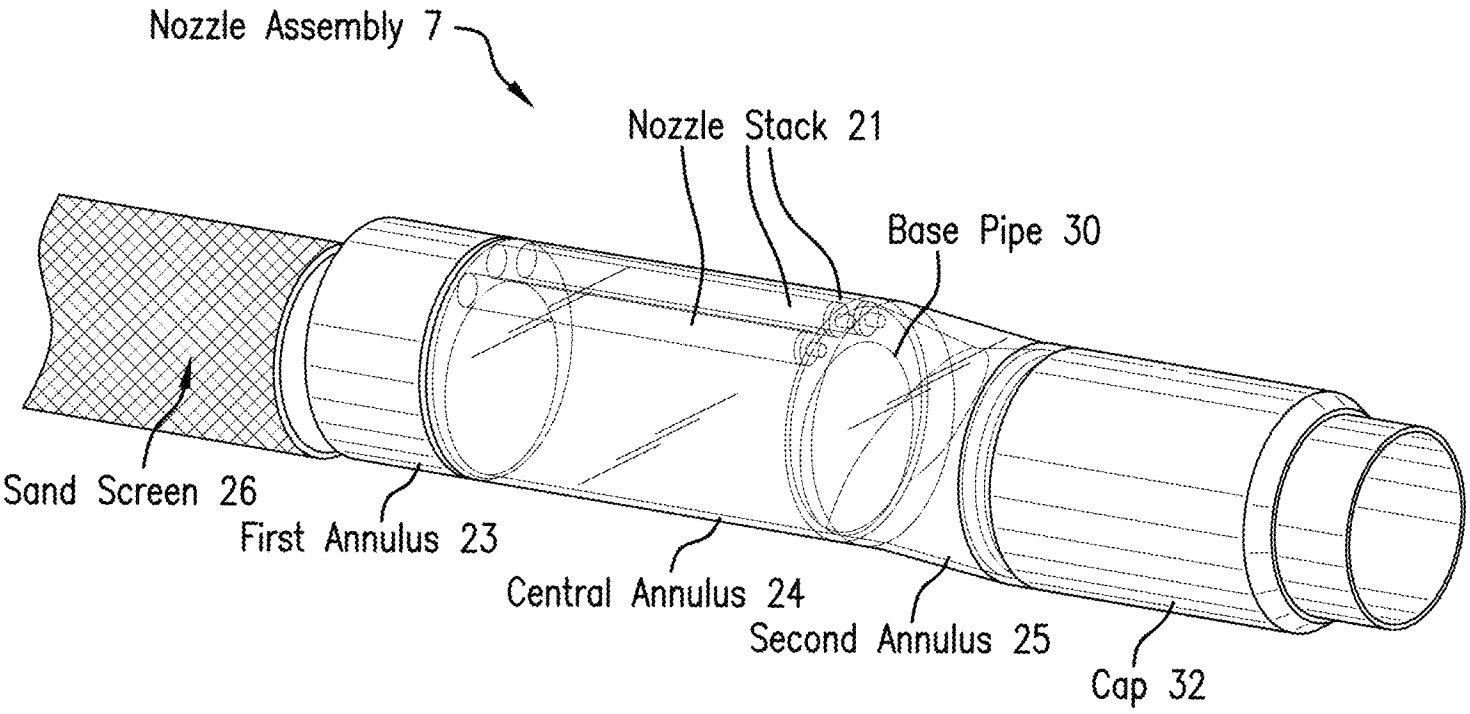
FIG. 3 depicts aspects of the flow nozzle assembly in a three-dimensional view.

FIG. 3 depicts aspects of the flow nozzle assembly 7 in a three-dimensional view. In the embodiment of FIG. 3, the central annulus 24 is not symmetrical about the basepipe 30, but has an eccentric cross-section. The eccentric cross-section provides more space on one side of the basepipe 30 in order to dispose one or more nozzle stacks 21. In the embodiment of FIG. 3, sufficient space is provided to house three nozzle stacks 21 in parallel.

Figure 4A:
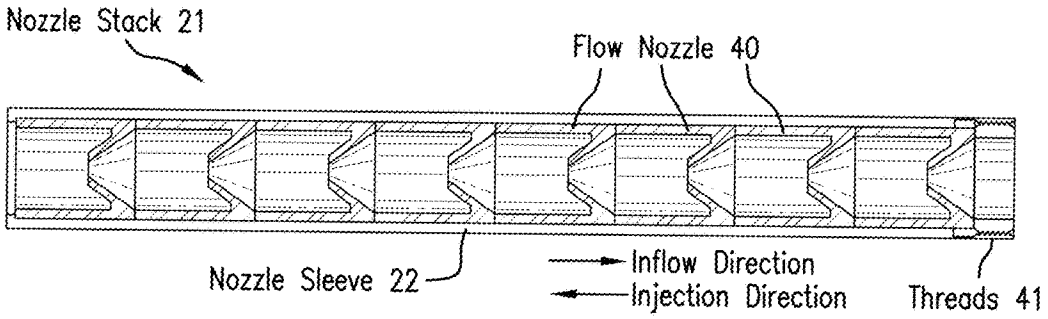
FIGS. 4A and 4B, collectively referred to as FIG. 4, depict aspects of a nozzle stack having a plurality of flow nozzles in a series arrangement.
Figure 4B:
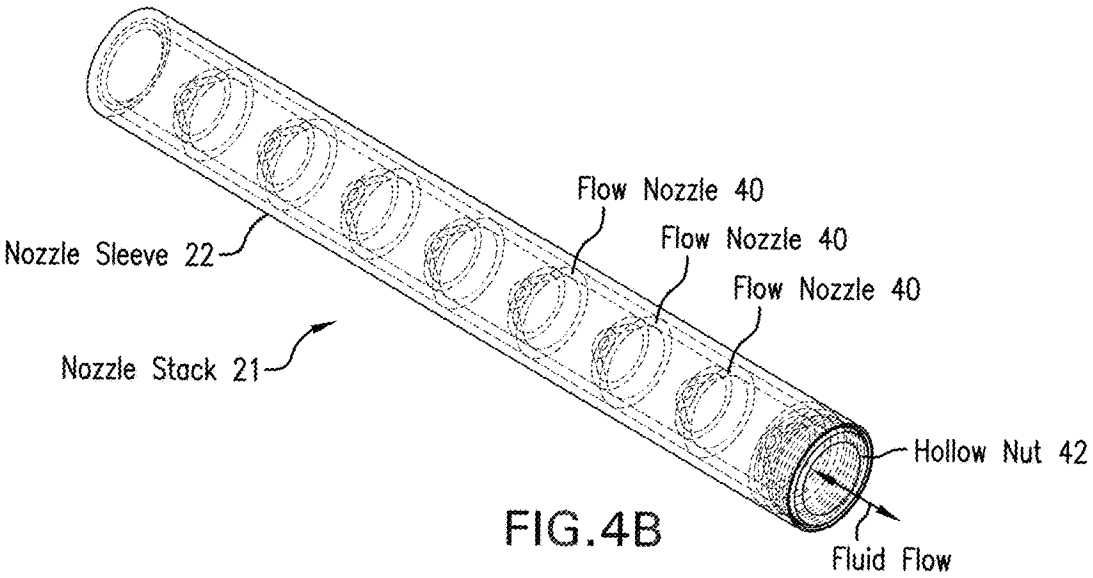
Figure 5A:
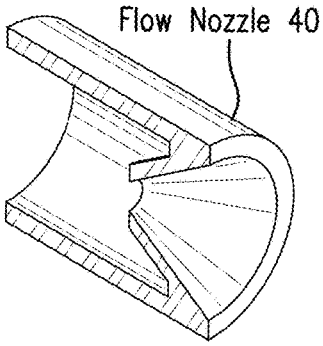
FIGS. 5A-5E, collectively referred to as FIG. 5, depict aspects of a flow nozzle in the nozzle stack.
Figure 5B:
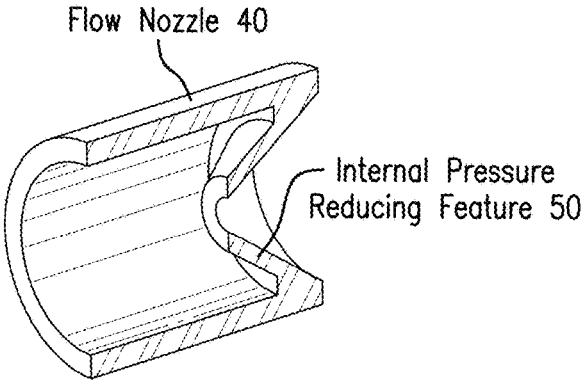
Figure 5C:
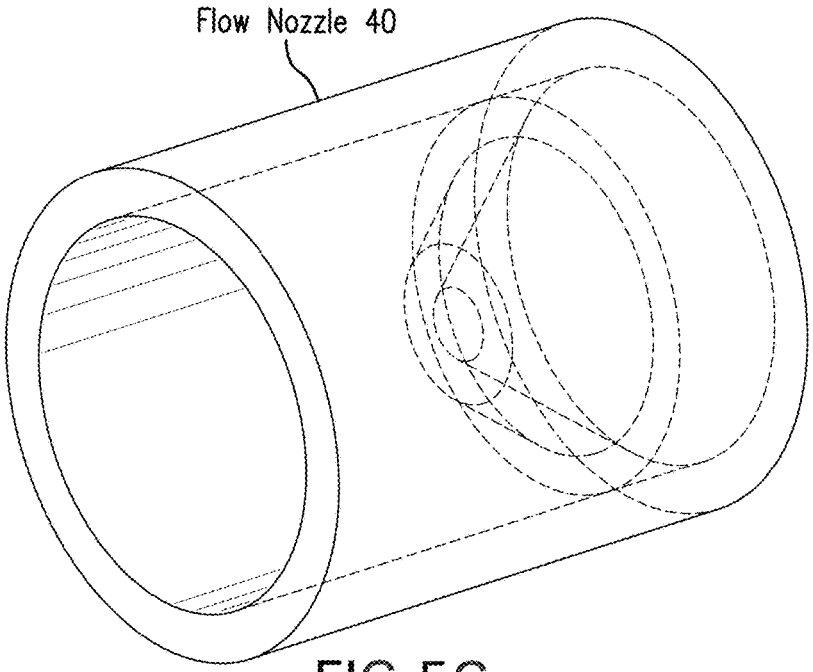
Figure 5D:
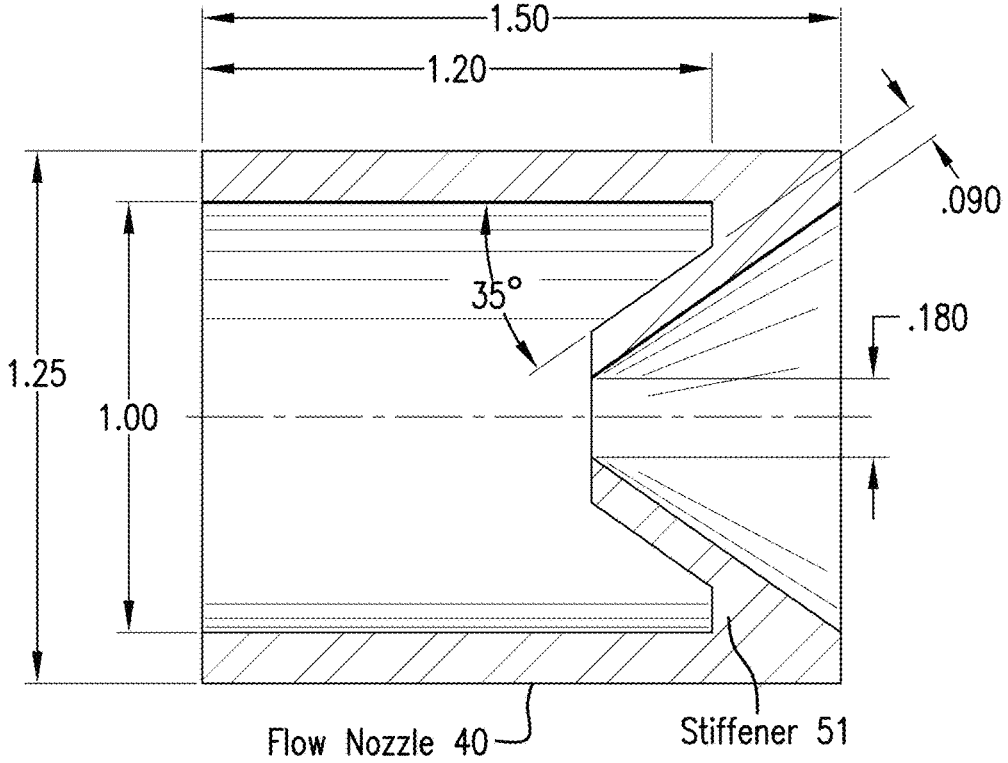
Figure 5E:
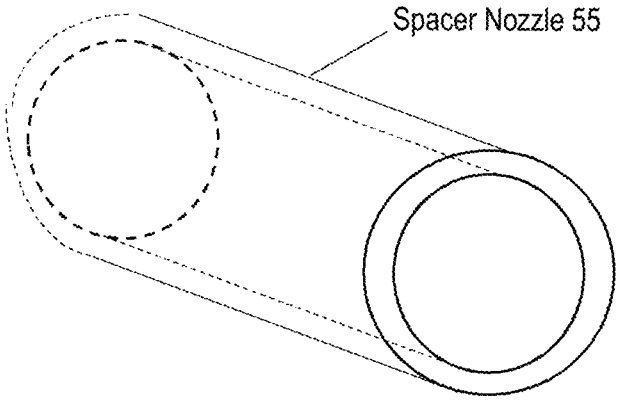

FIG. 4 depicts aspects of the nozzle stack 21. FIG. 4A illustrates a cross-sectional view while FIG. 4B illustrates a three-dimensional view. The nozzle stack 21 includes a plurality of flow nozzles 40 in a series arrangement that is held together by the nozzle sleeve 22. The nozzle sleeve 22 includes threads 41 that are configured to engage a hollow nut 42 in order to secure the plurality of flow nozzles 40 in the nozzle sleeve 22. Other types of mechanical securing devices may also be used. In one or more embodiments, the nozzle sleeve 22 is a cylindrical tubular. In other embodiments, the nozzle sleeve can be a tubular with other geometrical cross-sectional shapes that can conform to outside dimensions of the flow nozzles 40.

FIG. 5 depicts aspects of one embodiment of the flow nozzle 40. FIGS. 5A and 5B illustrate three-dimensional views of the flow nozzle 40 split in half along the longitudinal axis. FIG. 5C illustrates a three-dimensional views of a complete flow nozzle 40 while FIG. 5D illustrates a dimensioned cross-sectional views. Each flow nozzle 40 includes an internal pressure-reducing feature 50. In one or more embodiments, the internal pressure reducing feature 50 is a cone or conical shape defining an opening at the center of the cone or shape. The narrow dimension or diameter of the cone is oriented toward fluid flowing in the inflow direction. The wide dimension or diameter of the cone is oriented toward fluid flowing in the injection flow direction. This orientation provides for a pressure drop in the inflow direction that is higher than the pressure drop in the injection flow direction. The dimensions provided are for illustration and teaching purposes and can vary depending on a specific application. Dimensions can be determined by analysis, testing and/or a combination of analysis and testing in order to provide a desired flow or pressure reduction characteristic. Testing may be performed on the types of fluids expected downhole. A stiffener 51 may be disposed where the conical shape contacts the nozzle body in order to increase the rigidity of the conical shape to improve the accuracy and precision of pressure drops. As an alternative to the conical shape, a tapered shape such as a rectangular or triangular tapered shape defining an opening may also be used. As illustrated in FIG. 5E, a spacer nozzle 55 that does not have any internal pressure reducing features may be used in the nozzle stack 21 in order to take up space when a flow nozzle 40 with internal pressure reducing features is not required. The flow nozzles 40 are made from an erosion resistant material that can survive the high temperatures, high pressures and chemicals in a downhole environment such as tungsten carbide or a ceramic material in non-limiting embodiments.

Figure 6A:
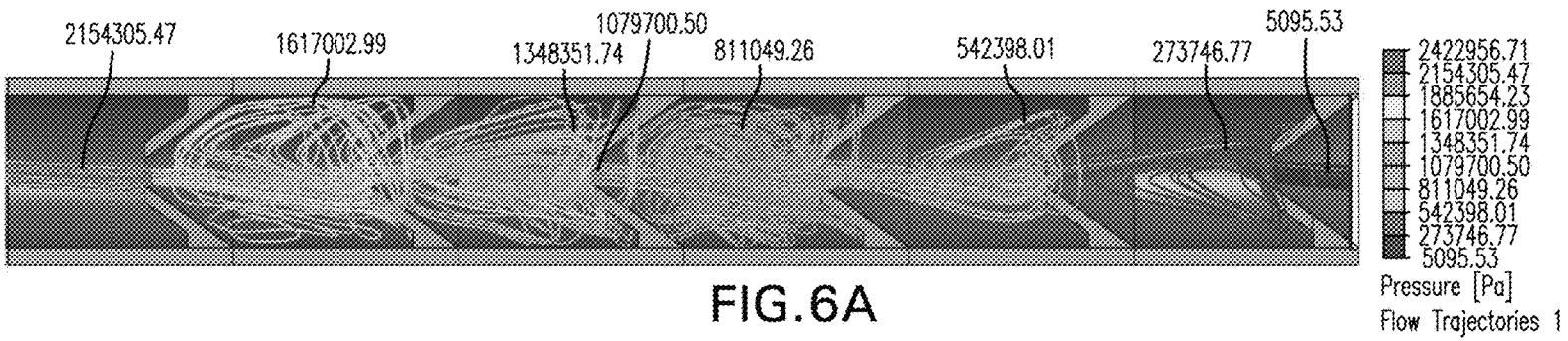
FIGS. 6A and 6B, collectively referred to as FIG. 6, depict aspects of fluid flow through a plurality of flow nozzles coupled together in a series arrangement.
Figure 6B:
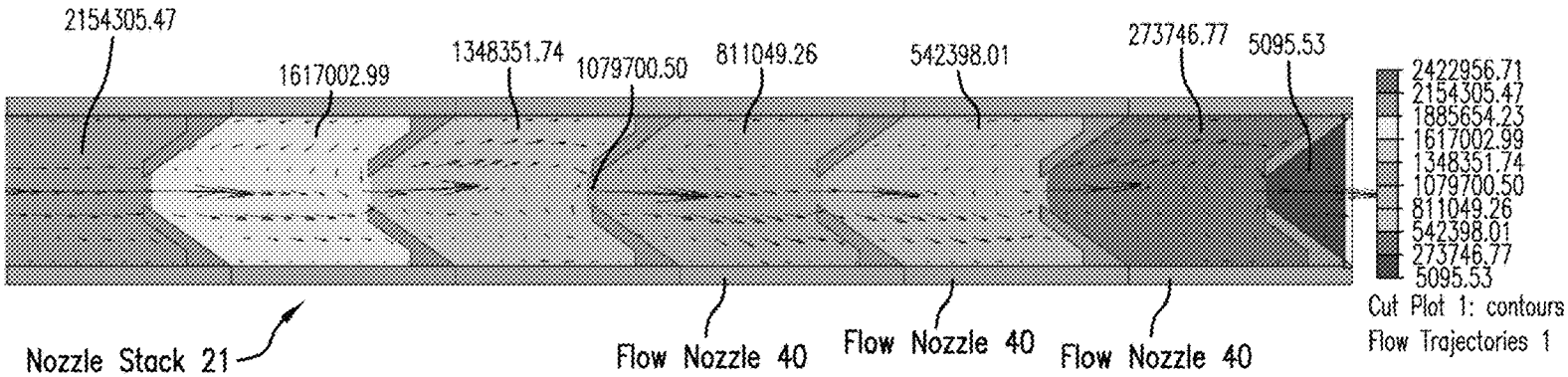

FIG. 6 depicts aspects of fluid flow in the inflow direction through the plurality of flow nozzles 40 coupled together in the series arrangement. FIG. 6A illustrates paths or trajectories of various fluid streams in the fluid flow. It is noted that those fluid streams not directed into the opening of the cone-shaped restriction follow a curved path in the volume between that cone-shaped restriction and the previously traversed cone-shaped restriction. This behavior illustrates why the pressure drop in the inflow direction is greater than the pressure drop in the injection flow direction. FIG. 6B illustrates the pressure drops of fluid as the fluid traverses each flow nozzle 40. It can be appreciated that flow nozzles in the nozzle stack can (1) all have the same pressure drop characteristic, (2) all have different pressure drop characteristics, (3) have any combination of nozzles with the same and/or different pressure drop characteristics, or (4) can include one or more spacer nozzles in a nozzle stack. Further, in embodiments having multiple nozzle stacks, each nozzle stack can have the same total pressure drop characteristic, different pressure drop characteristics, or some combination where some nozzle stacks have the same pressure drop characteristic and other nozzle stacks have different pressure drop characteristics.

Figure 7:
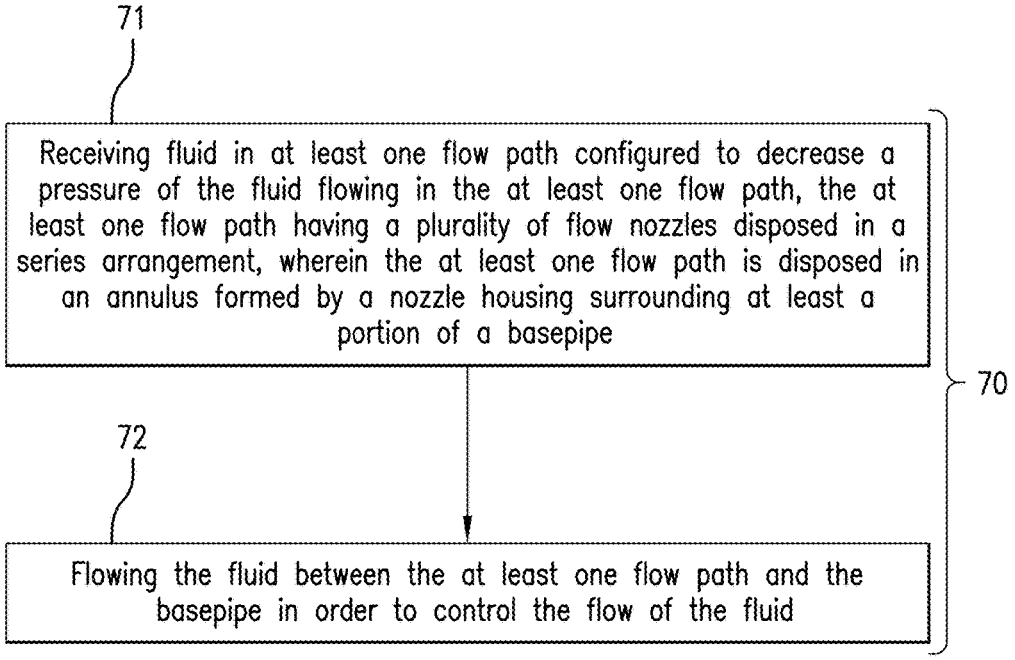
FIG. 7 is a flow chart for a method for controlling inflow of fluid.

FIG. 7 is a flow chart for a method 70 for controlling a flow of fluid downhole. Block 71 calls for receiving the fluid using a removable fluid nozzle in fluid communication with a production tubular disposed in a borehole penetrating the earth, the removable fluid nozzle being configured for bi-directional flow, wherein a pressure drop of fluid flow in one direction is greater than the pressure drop of fluid flow in the other direction. In one or more embodiments, the higher pressure drop is in an inflow direction from the earth formation and the lower pressure drop is in an injection flow direction into the earth formation. Block 72 calls for flowing the fluid between the removable fluid nozzle and the production tubular in order to control the flow of the fluid. Block 72 can include flowing the fluid in an inflow direction or flowing the fluid in an injection flow direction. The method 70 may also include: receiving the fluid in at least one flow path configured to decrease a pressure of fluid flowing in the at least one flow path, the at least one flow path comprising a plurality of flow nozzles disposed in a series arrangement, wherein the at least one flow path is disposed in an annulus formed by a nozzle housing or shell surrounding at least a portion of a basepipe disposed in a borehole penetrating the earth; and flowing the fluid between the at least one flow path and the basepipe in order to control the flow of the fluid.

The method 70 can also include screening formation fluid flowing in the inflow direction before the fluid enters the at least one flow path using a sand screen. The method 70 can also include removing a cap sealing the annulus from an outside environment; replacing one or more flow nozzles in the at least one flow path; and installing the cap to seal the annulus from the outside environment after replacing the one or more flow nozzles.

Embodiment 1

An apparatus for controlling a flow of fluid downhole, the apparatus comprising: a removable fluid nozzle in fluid communication with a production tubular disposed in a borehole penetrating the earth, the removable fluid nozzle being configured for bi-directional flow, wherein a pressure drop of fluid flow in one direction is greater than the pressure drop of fluid flow in the other direction.

Embodiment 2

The apparatus according to any prior embodiment, further comprising: a basepipe configured to be connected to the production tubular; a nozzle housing surrounding at least a portion of the basepipe to form an annulus surrounding at least a portion of the basepipe; and at least one flow path disposed in the annulus and configured to decrease a pressure of fluid flowing in the at least one flow path; wherein the removable fluid nozzle comprises a plurality of removable fluid nozzles disposed in a series arrangement in the at least one flow path, the at least one flow path being in fluid communication with the basepipe.

Embodiment 3

The apparatus according to any prior embodiment, wherein each flow nozzle comprises a flow restriction having a conical shape with a first diameter at one end of the conical shape and a second diameter greater than the first diameter at an opposing end of the conical shape, the conical shape defining an opening.

Embodiment 4

The apparatus according to any prior embodiment, each flow nozzle comprises a nozzle body with the conical shape disposed in and contacting the nozzle body.

Embodiment 5

The apparatus according to any prior embodiment, further comprising a stiffener disposed where the conical shape contacts the nozzle body.

Embodiment 6

The apparatus according to any prior embodiment, further comprising a nozzle spacer comprising the nozzle body without the flow restriction.

Embodiment 7

The apparatus according to any prior embodiment, wherein the first diameter is directed toward fluid flowing from the earth formation and into the basepipe and the second diameter is directed toward fluid flowing from the basepipe and into the earth formation.

Embodiment 8

The apparatus according to any prior embodiment, wherein fluids with unwanted properties flowing from the earth formation and into the basepipe have a higher pressure drop than fluids with desired properties flowing from the earth formation and into the basepipe.

Embodiment 9

The apparatus according to any prior embodiment, wherein the annulus comprises a first annulus directed toward fluid flowing from the earth formation, a second annulus directed toward fluid flowing from the basepipe, and a central annulus that is between the first annulus and the second annulus, and wherein the at least one flow path disposed in the central annulus.

Embodiment 10

The apparatus according to any prior embodiment, further comprising a first tube sheet separating the first annulus from the central annulus and a second tube sheet separating the second annulus from the central annulus, wherein the first and second tube sheets are configured to isolate an exterior of the at least one flow path from fluid in first annulus and/or the second annulus.

Embodiment 11

The apparatus according to any prior embodiment, wherein the basepipe defines one or more perforations in a region of the second annulus to provide fluid communication between the second annulus and the basepipe.

Embodiment 12

The apparatus according to any prior embodiment, further comprising a cap configured to be sealed to the second annulus and to be removed to provide access for removal and replacement of at least one flow nozzle in the at least one flowpath.

Embodiment 13

The apparatus according to any prior embodiment, further comprising a sand screen covering one or more openings to a screened annulus that is in fluid communication with the first annulus.

Embodiment 14

The apparatus according to any prior embodiment, wherein the first annulus comprises a modular adapter ring configured to adapt the screened annulus to the central annulus such that fluid communication is provided between the screened annulus and the at least one flow path.

Embodiment 15

The apparatus according to any prior embodiment, further comprising a sleeve supported by the first tube sheet at one end and the second tube sheet at an opposing end, wherein the sleeve is configured to hold the plurality of flow nozzles in the series arrangement.

Embodiment 16

The apparatus according to claim any prior embodiment, wherein the sleeve is threaded at one end and the apparatus further comprises a nut having an open center and configured to engage the threads in order to secure the plurality of flow nozzles in the sleeve.

Embodiment 17

A method for controlling a flow of fluid downhole, the method comprising: receiving the fluid using a removable fluid nozzle in fluid communication with a production tubular disposed in a borehole penetrating the earth, the removable fluid nozzle being configured for bi-directional flow, wherein a pressure drop of fluid flow in one direction is greater than the pressure drop of fluid flow in the other direction; and flowing the fluid between the removable fluid nozzle and the production tubular in order to control the flow of the fluid.

Embodiment 18

The method according to any prior embodiment, wherein the fluid flows from an earth formation, into the at least one flow path, and into the basepipe.

Embodiment 19

The method according to any prior embodiment, wherein the fluid flows from the basepipe, into the at least one flow path, and into an earth formation.

Embodiment 20

The method according to any prior embodiment, further comprising: removing a cap sealing the annulus from an outside environment; replacing one or more flow nozzles in the at least one flow path; and installing the cap to seal the annulus from the outside environment after replacing the one or more flow nozzles.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" are used to distinguish elements and are not used to denote a particular order.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for controlling a flow of fluid downhole, the apparatus comprising:

a removable fluid nozzle in fluid communication with a production tubular disposed in a borehole penetrating an earth formation, the removable fluid nozzle being configured for bi-directional flow, wherein a pressure drop of fluid flow in one direction is greater than the pressure drop of fluid flow in the other direction;

a basepipe configured to be connected to the production tubular;

a nozzle housing surrounding at least a portion of the basepipe to form an annulus surrounding at least a portion of the basepipe; and at least one flow path comprising a nozzle sleeve disposed in the annulus and configured to decrease a pressure of fluid flowing in the at least one flow path, the at least one flow path being in fluid communication with the basepipe at one end and in fluid communication with the earth formation at another end;

wherein the removable fluid nozzle is disposed in the nozzle sleeve.

2. The apparatus according to claim 1, wherein the removable fluid nozzle comprises a plurality of removable fluid nozzles disposed in a series arrangement in the nozzle sleeve.

3. The apparatus according to claim 1, wherein each flow nozzle comprises a flow restriction having a conical shape with a first diameter at one end of the conical shape and a second diameter greater than the first diameter at an opposing end of the conical shape, the conical shape defining an opening.

4. The apparatus according to claim 3, each flow nozzle comprises a nozzle body with the conical shape disposed in and contacting the nozzle body.

5. The apparatus according to claim 4, further comprising a stiffener disposed where the conical shape contacts the nozzle body.

6. The apparatus according to claim 4, further comprising a nozzle spacer comprising the nozzle body without the flow restriction.

7. The apparatus according to claim 3, wherein the first diameter is directed toward fluid flowing from the earth formation and into the basepipe and the second diameter is directed toward fluid flowing from the basepipe and into the earth formation.

8. The apparatus according to claim 7, wherein fluids with unwanted properties flowing from the earth formation and into the basepipe have a higher pressure drop than fluids with desired properties flowing from the earth formation and into the basepipe.

9. The apparatus according to claim 1, wherein the annulus comprises a first annulus directed toward fluid flowing from the earth formation, a second annulus directed toward fluid flowing from the basepipe, and a central annulus that is between the first annulus and the second annulus, and wherein the at least one flow path disposed in the central annulus.

10. The apparatus according to claim 9, further comprising a first tube sheet separating the first annulus from the central annulus and a second tube sheet separating the second annulus from the central annulus, wherein the first and second tube sheets are configured to isolate an exterior of the at least one flow path from fluid in first annulus and/or the second annulus.

11. The apparatus according to claim 9, wherein the basepipe defines one or more perforations in a region of the second annulus to provide fluid communication between the second annulus and the basepipe.

12. The apparatus according to claim 9, further comprising a cap configured to be sealed to the second annulus and to be removed to provide access for removal and replacement of at least one flow nozzle in the at least one flowpath.

13. The apparatus according to claim 9, further comprising a sand screen covering one or more openings to a screened annulus that is in fluid communication with the first annulus.

14. The apparatus according to claim 13, wherein the first annulus comprises a modular adapter ring configured to adapt the screened annulus to the central annulus such that fluid communication is provided between the screened annulus and the at least one flow path.

15. The apparatus according to claim 9, further comprising a sleeve supported by the first tube sheet at one end and the second tube sheet at an opposing end, wherein the sleeve is configured to hold the plurality of flow nozzles in the series arrangement.

16. The apparatus according to claim 15, wherein the sleeve is threaded at one end and the apparatus further comprises a nut having an open center and configured to engage the threads in order to secure the plurality of flow nozzles in the sleeve.

17. A method for controlling a flow of fluid downhole, the method comprising:

receiving the fluid using a removable fluid nozzle in fluid communication with a production tubular disposed in a borehole penetrating an earth formation, the removable fluid nozzle being configured for bi-directional flow, wherein a pressure drop of fluid flow in one direction is greater than the pressure drop of fluid flow in the other direction; and flowing the fluid in at least one flow path between the earth formation and the removable fluid nozzle at one end and between the removable fluid nozzle and a basepipe in fluid communication with the production tubular at another end in order to control the flow of the fluid;

wherein the removable fluid nozzle is disposed in a nozzle sleeve that is disposed in an annulus formed by a nozzle housing surrounding at least a portion of the basepipe.

18. The method according to claim 17, wherein the fluid flows from the earth formation, into the at least one flow path, and into the basepipe.

19. The method according to claim 17, wherein the fluid flows from the basepipe, into the at least one flow path, and into the earth formation.

20. The method according to claim 17, further comprising:

removing a cap sealing the annulus from an outside environment;

replacing one or more flow nozzles in the at least one flow path; and installing the cap to seal the annulus from the outside environment after replacing the one or more flow nozzles.

* * * * *